United States Patent [19]

Tricinella

[11] Patent Number: 4,864,898

[45] Date of Patent: Sep. 12, 1989

[54] COMBINATION POP-TOP CAN AND BOTTLE OPENER

[76] Inventor: Bruce E. Tricinella, 6242 Warner Ave., #22 G, Huntington Beach, Calif. 92647

[21] Appl. No.: 199,311

[22] Filed: May 26, 1988

[51] Int. Cl.[4] ..... B67B 7/44

[52] U.S. Cl. ..... 81/3.09; 81/3.55

[58] Field of Search ..... 81/3.09, 3.27, 3.4, 81/3.55, 3.57; 7/151; 30/450

[56] References Cited

U.S. PATENT DOCUMENTS

| | | | |
|---|---|---|---|
| 4,136,448 | 1/1979 | Fournier et al. | 30/450 |
| 4,373,223 | 2/1983 | Miller | 81/3.09 X |
| 4,524,646 | 6/1985 | Kimberlin, Jr. | 81/3.55 |
| 4,583,429 | 4/1986 | Krueger et al. | 81/3.55 |
| 4,617,842 | 10/1986 | Yang | 81/3.55 X |

OTHER PUBLICATIONS

Marks' *Standard Handbook for Mechanical Engineers,* Eighth Edition, McGraw-Hill Book Co., 1978, pp. 6-36 to 6-38.

*Primary Examiner*—Debra Meislin
*Attorney, Agent, or Firm*—Herb Boswell

[57] ABSTRACT

An opener for both pop-top cans and bottles is formed to include an elongated lever body. A lifting element is positioned on the lever body and is sized and shaped to fit underneath the lift tab on a pop-top can. A fulcrum element is further formed on the lever body in physical association with the lift element but spaced away from the lift element so as to form a channel between the lift element and the fulcrum element. The channel is sized and shaped such that the lift tab of the pop-top can can be sheaved in the channel between the lift element and the fulcrum element for manipulation of the lift tab to open the pop-top can. The opener further includes a bottle cap edge gripper located on the lever body in physical association with the fulcrum element. For removing bottle caps from capped bottles, the bottle cap edge gripper is independently formed and then positioned on the opener such that it engages the edge of the bottle cap when the fulcrum element is positioned in the center of the bottle cap.

7 Claims, 1 Drawing Sheet

COMBINATION POP-TOP CAN AND BOTTLE OPENER

BACKGROUND OF THE INVENTION

This invention is directed to a combination pop-top can and bottle opener. The opener of the invention is capable of opening either capped bottles or pop-top cans of the type having a lift tab.

Two of the most popular ways of dispensing individual servings of beverages are in pop-top beverage cans and capped bottles. A modern pop-top beverage can utilizes a lift tab which is permanently attached to the lid of the can. In lifting the tab, an end of the tab depresses a section of the top of the can which is scored on three sides. The end of the tab presses the scored area inwardly into the can to form an opening in the can. Once the can has been opened the tab is bent back flat and flush against the top of the can allowing the contents of the can to either be poured out or to be removed from the can by drinking directly from the can.

While the above described pop-top cans are very convenient, certain individuals have difficulty in opening them. This includes, children and other individuals having small digits on their hands or weak hands, persons with diseased or injured hands and persons having long fingernails which they desire to remain in tact.

Person with long delicate fingernails or arthritic hands and the like sometimes attempt to open pop-top cans by wedging an instrument such as a spoon handle, fork or the like underneath the lift tab to initially raise this tab up from the top surface of the can. While at times this might be utilitarian and serve to lift the lift tab up from the top surface of the can it can scratch or mar the lifting instrument, inadvertently torque the lift tab to sever it from the top of the can or potentially slip from the top of the can resulting in inadvertent cuts, scrapes and the like.

Individual capped bottles of beverages generally are bottled in either a bottle which has a lift off cap which must be removed with an opener, or a screw off cap which theoretically can be removed by twisting off the top of the bottle. It goes without saying that the caps designed to be removed with an opener or other implement cannot be opened without that implement. With twist off caps the force necessary to remove the cap is such that the same group of individuals which have difficulty with pop-top cans also have difficulty in removing the twist off caps from bottles sealed with twist off caps. These persons must result to utilizing an opener or the like to remove the twist off cap.

A variety of openers suitable for removing the caps on bottles are known and used. These bottle cap openers however have little utility in opening pop-top cans. Attempts to use thesr implements to assist in opening pop-top cans is either ineffective, awkward or dangerous. During the course of a days employment a bartender or other person who dispenses beverages may be required to open hundreds of pop-top cans and capped bottles. This continuous opening of pop-top cans can be very devastating to decorative fingernails and further it can be very irritating to the skin of the fingers because of the volume of lift tabs which must be manipulated.

BRIEF DESCRIPTION OF THE INVENTION

From the above it is evident that there exists a need for new and improved tools for assisting in opening of pop-top cans. Further, it is evident that there exists a need for new and improved tools which can be used for both opening pop-top cans and removing caps from capped bottles. In view of this it is a broad object of this invention to provide for a combination pop-top can and bottle opener. It is a further object of this invention to provide for a pop-top can opener capable of assisting in lifting and rotating the lift tab of a pop-top can. It is an additional object of this invention to provide for openers of the type described above which are designed and engineered for the convenience of the user but still are capable of a long and useful lifetime.

These and other objects as will become evident from the remainder of this specification are achieved in a combination pop-top can and bottle opener which includes a lever body having a lifting means for fitting underneath a pop-top can lift tab on a pop-top can. Further, a fulcrum means is formed on the lever body in physical association with the lifting means. The fulcrum means is for engaging either the top of a bottle cap or one surface of the pop-top lift tab. Together the fulcrum means and the lifting means define a channel formed as an opening between the fulcrum means and the lifting means. The channel is capable of sheaving or enveloping the lift tab of the pop-top can to interleave the pop-top lift tab between the lifting means and the fulcrum means. A bottle cap edge gripper is further located on lever body in physical association with the fulcrum means. Together the bottle cap edge gripper and the fulcrum means are utilized to remove a cap from a bottle.

Preferredly the bottle cap edge gripper means is formed independent from the remainder of the bottle opener and of a metallic component. Preferredly the remainder of the bottle opener is formed of a very stiff resilient polymeric material as, for instance a fiber impregnated polyamide polymeric material.

The lifting means can be formed as an elongted planar element on an elongated lever body. The fulcrum means can be formed as a further element on the lever body which extends, at least in part, at an angle from the elongated axis of the lever body. The fulcrum element can be formed as an arcuate element which curves away from the elongated axis of the lever body. Together the elongated planar element and the fulcrum element define a channel which has parallel walls which are capable of easily slipping over and then interleaving with the lift tab of a pop-top can.

BRIEF DESCRIPTION OF THE DRAWINGS

This invention can be better understood when taken in conjunction with the figures wherein.

This invention utilizes certain principles and/or concepts as are set forth in the claims appended hereto.

Those skilled in the package and utensil arts will realize that these principles and/or concepts are capable of being utilized by a variety of embodiments which may differ from the exact embodiments used for illustrative purposes herein. For this reason this invention is not to be construed as being limited solely to the illustrative embodiments, but should only be construed in view of the claims appended hereto.

DETAILED DESCRIPTION OF THE INVENTION

Figure 5:
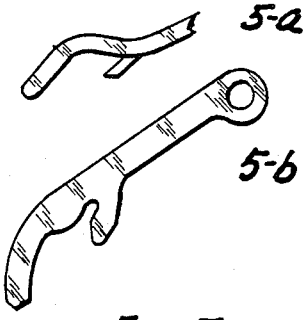
FIG. 5 PRIOR ART
FIG. 5 is a side elevational view of first and second prior art bottle cap removers.

FIG. 5*a* illustrates one end of a widely used bottle cap opener. This opener is formed on one end of steel implement which normal includes a can opener on its other end. A tang is punched or stamped from the center of the implement and bend out of the plane of the implement. While ubiquitous in their use, this type of opener tends to rust and is not of a size which can conveniently be carried in pocket or purse.

In FIG. 5*b* a further type of bottle opener is illustrated. This opener is formed of aluminum or an aluminum alloy and as such does not rust as does the above opener; however, because it is extruded from aluminum or an aluminum alloy the edges of the bottle caps it is used to remove soon abrade it, rendering it useless as well as potentially dangerous. This opener also includes a shallow notch for engaging a pop-top can lift tab; however, because this notch is very shallow it easily slips from the pop-top tab. Further this notch is located in that area of the opener which tends to be abraded by opening bottles. As this area wears, the opener becomes even less effective in assisting in opening pop-top cans.

Figure 1:
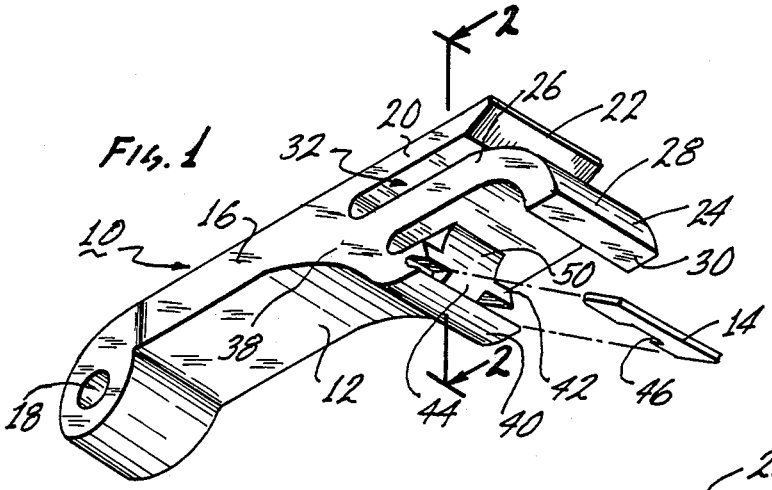
FIG. 1 is an exploded isometric view of a combination pop-top can and bottle opener of the invention showing the side, bottom and front of this opener.

A combination pop-top can and bottle opener 10 of the invention is capable of both opening a pop-top can and removing the cap from a capped bottle. The opener 10 is generally formed in two separate pieces of two separate materials. It includes a body 12 and an edge gripper plate 14. In FIG. 1 the edge gripper plate 14 is shown exploded away from the remainder of the body 12.

The body 12 is formed as a unified structure from a suitable material. Preferredly it is formed of a polymeric material which when polymerized is strong and stiff and is incapable of bending or breaking during use. Suitable for forming the body 12 would be a polyamide as, for instance a nylon. This material is improved by incorporating fibers in the material for added strength against flexure. Thus, preferred for forming the body 12 would be a glass fiber filled nylon. Many commercial formulations of such fiber filled polymeric materials are available for use with common molding machines, as for instance, injection molding machines.

The edge gripper plate is preferredly formed of a metal. Most useful because of its properties would be stainless steel. By utilizing stainless steel for forming the edge gripper plate 14, not only will the edge gripper plate 14 not rust, but it is also essentially impervious to deformation by the edges of bottle caps when it is pried against these edges. Many prior bottles are formed either of regular steel which tends to rust with use or of aluminum which is abraded by the edges of the bottle caps and thus limits the lifetime of such an aluminum bottle opener.

The body 12 of the opener 10 has a handle portion 16 which includes an eye 18 allowing for attachment of the opener 10 to a key ring, a chain or the like to assist in maintaining the opener 10 easily accessible to the user.

Extending from the handle 16 is a lift element 20. The lift element 20 includes a wedge surface 22 on its end.

The body 12 of the opener 10 is formed of an essentially elongated lever with this elongated structure continuing in the lift element 20. As such the lift element 20 is formed as an elongated planar surface which is capable of being slid underneath the lift tab of a pop-top can. The wedge surface 22 assists in positioning of the lift element 20 underneath the lift tab of the pop-top can.

A fulcrum element 24 is formed on the body 12 adjacent to the lift element 20. A first portion of the fulcrum element, a straight portion 26 extends essentially parallel to the lift element 20. The fulcrum element 24 then curves in an arcuate portion 28 away from the lift element 20. The end of the arcuate portion 28 culminates in engagement end 30 which fits against the center top of a cap when the opener 10 is utilized to open bottles.

The fulcrum element 24 and the lift element 20 are spaced apart from one another forming a channel 32 between them. The channel 32 is thus formed as an opening in the body 12. The inside walls of the channel 32 are parallel to one another and are spaced apart from one another a distance sufficient to allow for positioning or sheaving of the lift tab of a pop-top can between the lift element 20 and the fulcrum element 24 within the channel 32. Because the lift tabs of a pop-top can are flat planar structures and because the channel 32 is essentially formed as a flat planar opening the flat planar lift tab is snugly engaged, enveloped or sheaved within the channel 32 once the lift element 20 is slid underneath the lift tab.

Figure 3:
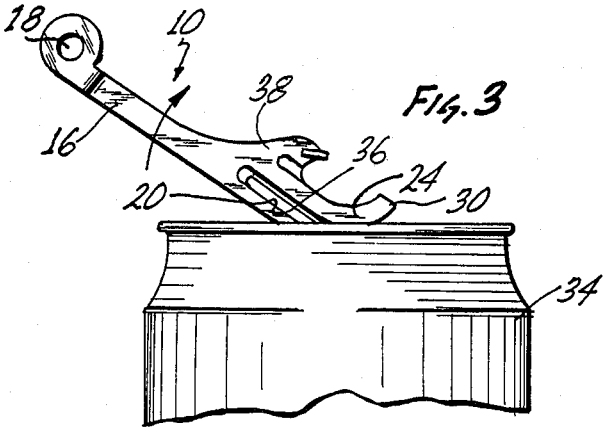
FIG. 3 is a side elevational view of a combination pop-top can and bottle opener of the invention showing the use of the opener in opening a pop-top can.
Figure 2:
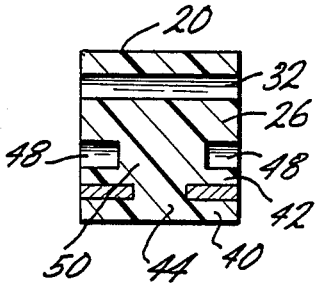
FIG. 2 is a sectional view about the line 2—2 of FIG. 1.

In FIG. 3 an opener 10 of the invention is being utilized to open a pop-top can 34. To open the can 34 the lift element 20 is slid underneath the lift tab 36 of the can 34. The wedge surface 22 assists in initially raising the lift tab 36 from the top surface of the can 34. Once the lift tab 36 is positioned in the channel 32 between the lift element 20 and the fulcrum element 24, the opener 10 is then rotated to lift the lift tab 36 and rotate it with respect to the top of the can 34 to open the can 34. Because the channel 32 is deep, of a dimension sufficient to sheave almost all of the lift tab 36 within it, the lift tap 36 will not slip or slide out of the channel 32. This prevents breaking off of the tab as can happen if the tab is twisted improperly by hand or with other implements. If the tap is broken off the can prior to opening the can, of course the contents of the can are unatainable.

Also, because the user of the can 34 does not have to initially pry the lift tab 36 from the surface of the can 34, the fingernails of the user are not in jeopardy of being broken and because of the mechanical advantage achieved with the opener 10, children and other individuals with weak or diseased hands can effectively open the pop-top can 34 with ease.

For opening bottles, in combination with the fulcrum element 24, the body 12 of the opener 10 includes an edge gripping plate foundation area 38. The foundation area 38 is formed as a projection of the body 12 which extends away from the elongated axis of the body 12. The area 38 includes a bottom lip 40 which is spaced away from a top lip 42 with a central web 44 located and extending between the lips 40 and 42.

The edge piece 14 is formed with a cutout 46 which is sized and shaped to be slightly undersized with respect to the thickness of the central web 44. The thickness of the plate of the edge piece 14 is essentially the same as that between the top and bottom lips 40 and 42.

The edge piece 14 can be inserted over the central web 44 and forced onto the central web 44. Because the body 12 is made of a polymeric material there is certain cold flow of this material allowing for positioning and locking of the cutout 46 on the edge plate 14 over the central web 44 to permanently adhere the edge plate 14 to the body 12.

For ease in molding the body 12 cutout areas collectively identified by the numeral 48 are formed just above the top lip 42 to define a further web 50 which joins the foundation 38 to the fulcrum element 24.

Figure 4:
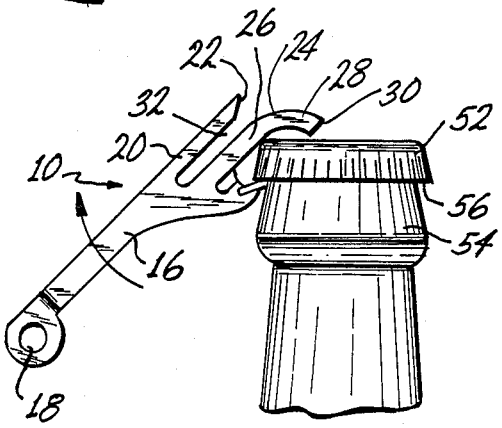
FIG. 4 is a side elevational view of a combination pop-top can and bottle opener of the invention showing the use of the opener in removing a bottle cap from a capped bottle.

In FIG. 4 the opener 10 of the invention is being utilized to remove a cap 52 from a bottle 54. To do so the edge plate 14 is located underneath the lip 56 of the cap 52 and the end of the fulcrum element 24 is positioned on top of the cap 52. Rotation of the opener 10 in a normal manner lifts the cap 52 from the bottle 54.

As so formed and constructed the opener 10 of the invention is utilitarian for opening both pop-top beverage cans and capped beverage bottles. Because the opener 10 is formed as a two piece opener utilizing a separate edge plate 14 from the body 12, advantage can be taken of both the metallic properties of the edge plate 14 for resisting wear in gripping a lip 56 of a cap 52 and the polymeric properties of the materials of the body 12 which are strong, sanitary and light weight.

Since the opener 10 is both small in size and does not have any sharp or protruding edges it can be conveniently carried in a pocket or purse without fear of either injury to ones body or ones clothing, purse or the like. Further, because of the shape of the opener 10, the only metallic component, i.e. the edge plate 14, is essentially recessed within the interior of the C shape formed by the fulcrum element 24 and the foundation area 38. This provides a safety feature compared to some other known metallic bottle openers.

What is claimed is:

1. A combination pop-top can and bottle opener which comprises:

a lever body formed as a unitary elongated body;

lifting means for fitting underneath a pop-top can lift tab on a pop-top can, said lifting means formed as an elongated planar portion of said unitary lever body;

said lifting means including a wedge surface means for fitting between a pop-top can lift tab and the top surface of said pop-top can;

fulcrum means for engaging either the top of a bottle cap or one surface of said pop-top lift tab, said fulcrum means formed as a further portion of said elongated lever body, said fulcrum means including a straight section and an arcuate section said straight section joining said arcuate section to the remainder of said lever body, said straight section of said fulcrum means located in a parallel planar association with said lifting means;

said lever body including a channel means formed as an opening between said lifting means and said straight section of said fulcrum means, said channel means for sheaving said pop-top lift tab to interleave said pop-top lift tab between said lifting means and said fulcrum means;

a stainless steel flat plate shaped gripping member for gripping an edge of a bottle cap, said gripping member formed independent of said lever body and essentially impervious to deformation by the edge of a bottle cap, said gripping member attached to said lever body in physical association with said fulcrum means; and said arcuate section of said fulcrum means curving away from said lifting means towards said gripping member.

2. A combination pop-top can and bottle opener of claim 1 wherein:

said unitary structure is formed of a fiber impregnated stiff unbendable polymeric material.

3. A combination pop-top can and bottle opener of claim 2 wherein:

said fiber impregnated polymeric material is a glass impregnated polyamide.

4. A combination pop-top can and bottle opener of claim 1 wherein:

said lifting means is formed as an elongated planar element on said lever body with the elongated axis of said planar element coaxial with the elongated axis of said body.

5. A combination pop-top can and bottle opener of claim 1 including:

a further portion of said lever body formed as a web; and said gripping member having a central cutout area therein, said gripping member attaching to said lever body by positioning of said gripping member cutout area onto lever body web.

6. A combination pop-top can and bottle opener consisting essentially of:

an elongated unitary lever body;

a portion of said lever body formed as an elongated planar lift element, the elongated axis of said lift element coaxial with the elongated axis of said lever body;

a further portion of said lever body formed as a fulcrum element, said fulcrum element including a straight section and an arcuate section, said straight section of said fulcrum element located on said lever body in association with said lift element and spaced away from said lift element to define a lift tab sheaving channel between said lift element and said fulcrum element, said lift tab sheaving channel formed with walls which are parallel to one another and which are spaced apart from one another a distance to accept positioning of a pop-top lift tab between said walls;

a further portion of said lever body formed as a web;

a flat planar bottle cap edge gripping member having a central cutout area therein, said gripping member formed independent from said lever body and attachable to said lever body in a location in operative association with said fulcrum element to position said fulcrum element between said member and said lift element, said gripping member attaching to said lever body by positioning said gripping member cutout area on said lever body web.

7. A combination pop-top can and bottle opener of claim 6 wherein:

said lever body including said lift element portion and said fulcrum element portions thereof are formed of a stiff unbendable fiber impregnated polymeric material; and said edge gripping member is formed of a metallic element.

* * * * *